US009103558B2

(12) United States Patent
Pine et al.

(10) Patent No.: US 9,103,558 B2
(45) Date of Patent: Aug. 11, 2015

(54) METHOD FOR DETECTING PHYSICAL PRESENCE OF A SPECIFIC INDIVIDUAL TO CONTROL HVAC SETTINGS

(75) Inventors: Matthew F. Pine, Allen, TX (US); Timothy E. Wallaert, Wylie, TX (US); Bobby DiFulgentiz, Frisco, TX (US)

(73) Assignee: Lennox Industries Inc., Richardson, TX (US)

( * ) Notice: Subject to any disclaimer, the term of this patent is extended or adjusted under 35 U.S.C. 154(b) by 842 days.

(21) Appl. No.: 13/332,826

(22) Filed: Dec. 21, 2011

(65) Prior Publication Data

US 2013/0166073 A1 Jun. 27, 2013

(51) Int. Cl.

| | |
|---|---|
| ***G05B 13/00*** | (2006.01) |
| ***G05B 15/00*** | (2006.01) |
| ***G05D 23/00*** | (2006.01) |
| ***G01C 21/00*** | (2006.01) |
| ***F24F 11/00*** | (2006.01) |

(52) U.S. Cl.

CPC ..... *F24F 11/0034* (2013.01); *F24F 2011/0035* (2013.01)

(58) Field of Classification Search

CPC ..... F24F 11/0009; F24F 11/00; F24F 11/001; F24F 11/0012; F24F 11/006; F24F 11/0034; F24F 11/0086; F24F 2011/0035; F24F 2011/0036; F24F 2011/0068; F24F 2011/0071; F24F 2011/0093; G05D 23/00; G05D 23/1932; H04L 67/125; G01S 19/34; G06Q 30/0261; G06Q 30/0269; G06Q 50/06; H04W 4/008

USPC ..... 700/275–277, 286, 291, 295–297; 340/531, 539.1, 539.11, 539.13, 340/239.14, 540, 686.1, 686.6; 236/1 C, 236/49.3, 51; 702/94, 97, 99, 130, 150, 702/155, 158

See application file for complete search history.

(56) References Cited

U.S. PATENT DOCUMENTS

| | | | | |
|---|---|---|---|---|
| 6,204,807 | B1 * | 3/2001 | Odagiri et al. | 342/357.57 |
| 7,224,966 | B2 | 5/2007 | Caspi et al. | |
| 8,024,073 | B2 * | 9/2011 | Imes et al. | 700/276 |
| 8,556,188 | B2 | 10/2013 | Steinberg | |
| 8,558,179 | B2 * | 10/2013 | Filson et al. | 250/349 |
| 8,571,518 | B2 | 10/2013 | Imes et al. | |
| 8,630,820 | B2 * | 1/2014 | Amis | 702/186 |
| 8,718,826 | B2 | 5/2014 | Ramachandran et al. | |
| 8,751,432 | B2 * | 6/2014 | Berg-Sonne et al. | 706/48 |
| 8,798,804 | B2 * | 8/2014 | Besore et al. | 700/296 |
| 2011/0153525 | A1 | 6/2011 | Benco et al. | |
| 2013/0073094 | A1 * | 3/2013 | Knapton et al. | 700/278 |

FOREIGN PATENT DOCUMENTS

| | | |
|---|---|---|
| FR | 2952168 | 5/2011 |
| JP | 2007051799 | 3/2007 |

(Continued)

OTHER PUBLICATIONS

European Search Report dated Mar. 11, 2014, Applicant: Lennox Industries, Inc., 6 pages.

*Primary Examiner* — Crystal J Barnes-Bullock

(74) *Attorney, Agent, or Firm* — Lennox Industries Inc.; Betty E. Ungerman; Osman Siddiq

(57) ABSTRACT

A heating, ventilation and air-conditioning system includes a system controller configured to control the operation of a demand unit to maintain an environmental set point of a control zone. The system controller is further configured to control the demand unit in response to a location signal received from a location-reporting device.

20 Claims, 7 Drawing Sheets

FOREIGN PATENT DOCUMENTS

| | | |
|---|---|---|
| JP | 2008267741 | 11/2008 |
| JP | 2009019860 | 1/2009 |
| JP | 2009052805 | 3/2009 |
| WO | 2011121299 A1 | 10/2011 |

* cited by examiner

METHOD FOR DETECTING PHYSICAL PRESENCE OF A SPECIFIC INDIVIDUAL TO CONTROL HVAC SETTINGS

TECHNICAL FIELD

This application is directed, in general, to heating, ventilating and air conditioning (HVAC) systems and, more specifically, to systems and methods for controlling temperature within a conditioned structure.

BACKGROUND

Heating, ventilating and air conditioning (HVAC) systems may provide cooling, heating, humidification and dehumidification of a home, business or other enclosed space. Development of such systems is ongoing to improve HVAC systems to meet such criteria as improved efficiency. Moreover, continued improvements in distributed computing systems have made possible HVAC controllers with greater computational capability while preserving a case style and size that resembles a wall-mounted thermostat and is therefore familiar to the user (e.g. a homeowner).

SUMMARY

One aspect provides a heating, ventilation and air-conditioning system that includes a system controller configured to control the operation of a demand unit to maintain an environmental set point of a control zone. The system controller is further configured to control the demand unit in response to a location signal received from a location-reporting device.

Another aspect provides a method of manufacturing a heating, ventilation and air-conditioning system. The method includes configuring a system controller to control the operation of a demand unit to maintain an environmental set point of a control zone. The system controller is further configured to control the demand unit in response to a location signal received from a location-reporting device.

BRIEF DESCRIPTION

Reference is now made to the following descriptions taken in conjunction with the accompanying drawings, in which:

FIG. 1 illustrates a system for communication between a mobile location-reporting device with an HVAC controller;

FIG. 2 schematically illustrates an HVAC controller configured to control an HVAC system in response to a temperature sensor;

DETAILED DESCRIPTION

The greater computational capability of HVAC controllers makes possible innovative functionality that anticipates the heating and/or cooling needs of an occupant and/or manages the "microenvironment" of the occupant. Thus, the occupant may have greater confidence that her comfort will be assured while, e.g. setting a lower setback temperature than would otherwise be the case.

Embodiments of the invention provide HVAC systems, and methods of manufacturing and controlling such systems, wherein a controller controls the operation of the system in response to a location of a location-reporting device. The location may be e.g. a ground track or a proximity to a fixed reference within a conditioned system. The location-reporting device may be collocated with a user, e.g. an occupant of a residence in which the system is installed. As the occupant moves relative to the residence, or moves within the residence, the controller may alter one or more environmental conditioning set points of the HVAC system in response to the movement. Thus, for instance, the controller may change the operational status of the residence from unoccupied to occupied, or change the status of a particular control zone within the residence from unoccupied to occupied.

Moreover, as discussed further below, multiple location-reporting devices, each collocated with one of multiple occupants of the residence, may allow the controller to respond to the independent movement of the multiple occupants, including, e.g. controlling more than one zone of the residence depending on occupancy status, giving one location-reporting device priority over another such device when both location-reporting devices are located in a same control zone, or giving one location-reporting device priority over another when two occupants near the residence. Thus, embodiments of the invention provide highly personalized comfort control within the residence and/or improved efficiency by automatically controlling various control zones depending on actual or predicted occupancy status.

Herein various embodiments may refer to a structure that is environmentally conditioned by an HVAC system as a "home", "residence", "house" or similar term. Such terms are used for convenience and clarity, but do not limit the scope of the invention to use in such structures. Unless otherwise stated, described embodiments and the claims apply to conditioned structures of any type in which an occupant may be present. Specific examples of such structures include without limitation single-family residential structures (houses), multi-family structures (apartments), office suites, and any other structure in which personalized comfort levels may be desirable.

Figure 1:
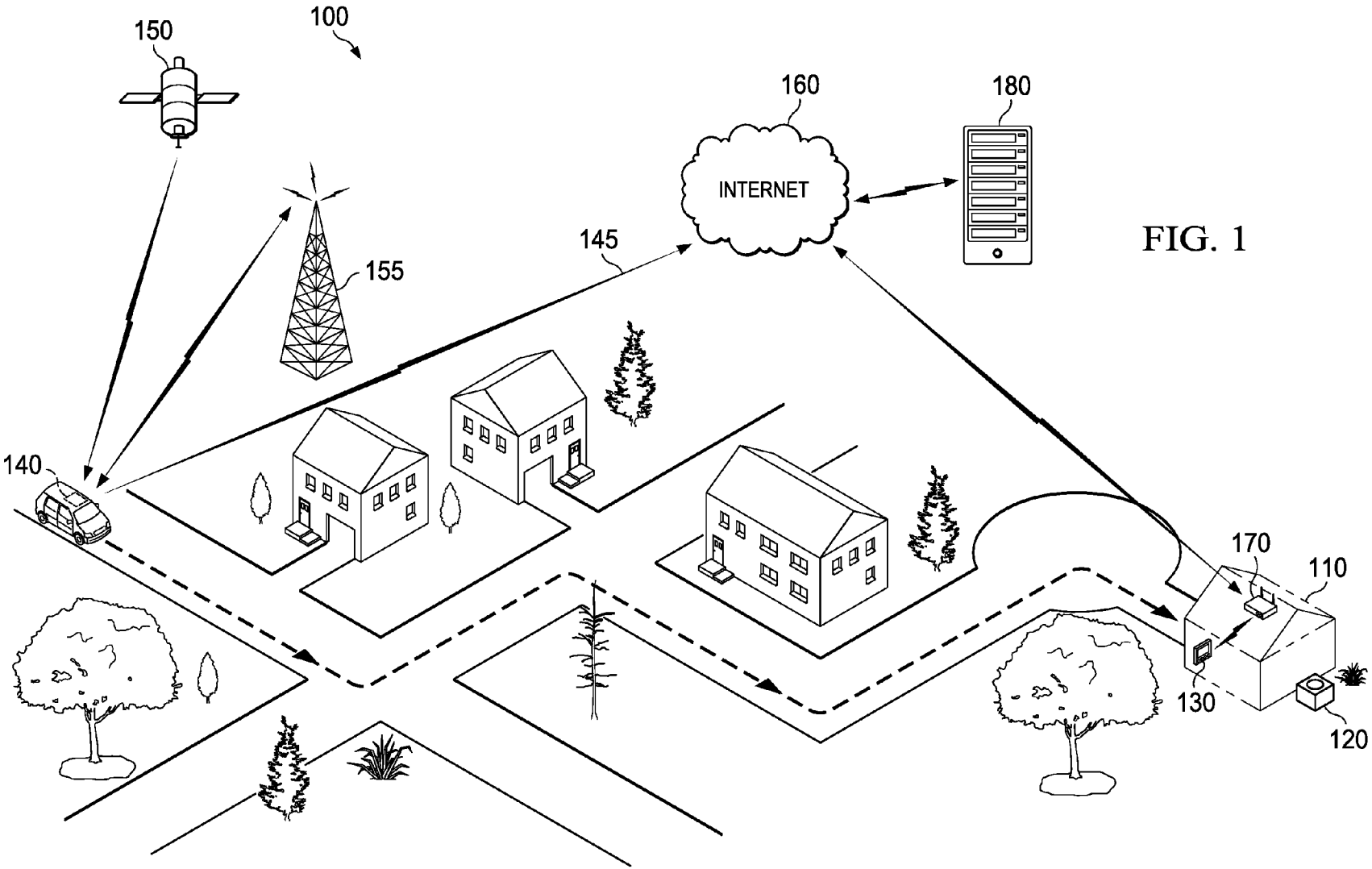

FIG. 1 illustrates in one illustrative and nonlimiting embodiment a system 100 for controlling environmental conditioning of a residence 110 by an HVAC system 120. The HVAC system 120 operates in response to commands from an HVAC controller 130 to maintain at least one environmental parameter set point within the residence 110, e.g. temperature or relative humidity (RH). Various embodiments are described with respect to temperature control by the controller 130, while recognizing that the scope of the embodiments and claims includes control of other environmental parameters.

The controller 130 operates to control the HVAC system 120 in part in response to a location-reporting device 140 that transmits a location signal 145. The embodiment of FIG. 1 illustrates an example of "coarse" location reporting by the device 140. Other embodiments, such as some described below, include examples of "fine" location reporting. As used herein a coarse position is one for which the positional uncertainty is comparable to or larger than reasonable dimensions of an interior room of the residence 110, e.g. larger than about 6 meters. As used herein a fine position is one for which the position may be determined with an uncertainty less than a reasonable maximum dimension of an interior room, e.g. about 6 meters. For example and without limitation, a global positioning system (GPS) receiver may report a coarse position, and an RFID transceiver may report a fine position.

The device 140 may be any type of device from which the position may be determined relative to the controller 130. The device 140 may be configured to determine its position, or the position of the device 140 may be determined by an interrogating device. In the embodiment of FIG. 1 it is contemplated that the device 140 is or includes a GPS receiver, a cellular telephone transceiver, or similar location-reporting device. As is well known, a GPS receiver may determine its ground position with reasonable precision (e.g. ±15 meters) in cooperation with a GPS satellite constellation represented by a satellite 150. The ground position may be represented by, e.g. global position coordinates such as latitude and longitude. A cellular telephone may determine a more approximate ground position by triangulation with a plurality of transmission towers represented by a tower 155. In some cases the device 140 may include both GPS and cellular location capabilities, such as some cellular telephones and mobile computing devices (e.g. laptop or tablet computing device).

The location-reporting device 140 in the illustrated embodiment is collocated with an automobile driven by, e.g. an occupant of the residence 110. The device 140 determines its position and reports the position data to the controller 130. In some embodiments reporting includes directly communicating position data to the controller 130 via the Internet 160 and a router 170. In such embodiments the controller 130 may be configured to process the location data to determine, e.g. a ground track or distance to the device 140. The location-reporting communication may be facilitated by a mobile application (a.k.a. an "app") installed on the device 140. In other embodiments the reporting may include directly communicating the position data to a server 180 via the Internet 160. The server 180 may be, e.g. a structurally conventional computing device configured to execute the novel server functions described herein. In these embodiments the server 180 may relieve the controller 130 of location data processing and may report to the controller 130 via the Internet 160 one or more derived location data, e.g. a distance between the controller 130 and the device 140.

The server 180 and/or the controller 130 may also provide various administrative and/or computational services. Without limitation, administrative services may include user administration and system administration. User administration may include, e.g. administering a user account, setting up a user profile, registering instances of the device 140, assigning a particular instance of the device 140 to a particular user, setting HVAC parameters associated with a group of users, administering a user group, and setting occupant priority levels. Priorities are discussed below in detail.

System administration functions provided by the controller 130 and/or the server 180 may include setting a size of a control zone associated with the residence 110 (see, e.g. FIG. 3A, control zone 315) and authenticating an instance of the device 140. Authentication may include, e.g. a security function such as password authentication. Authentication may in some embodiments make use of identity information, e.g. an occupant ID identifying the occupant collocated with the device 140. Computational services may include computing various parameters associated with one or more instances of the device 140. Parameters may include, without limitation, velocity, distance to the residence 110, distance to another device 140, a probability of arrival at the residence 110, and a time of arrival at the residence 110.

Figure 2:
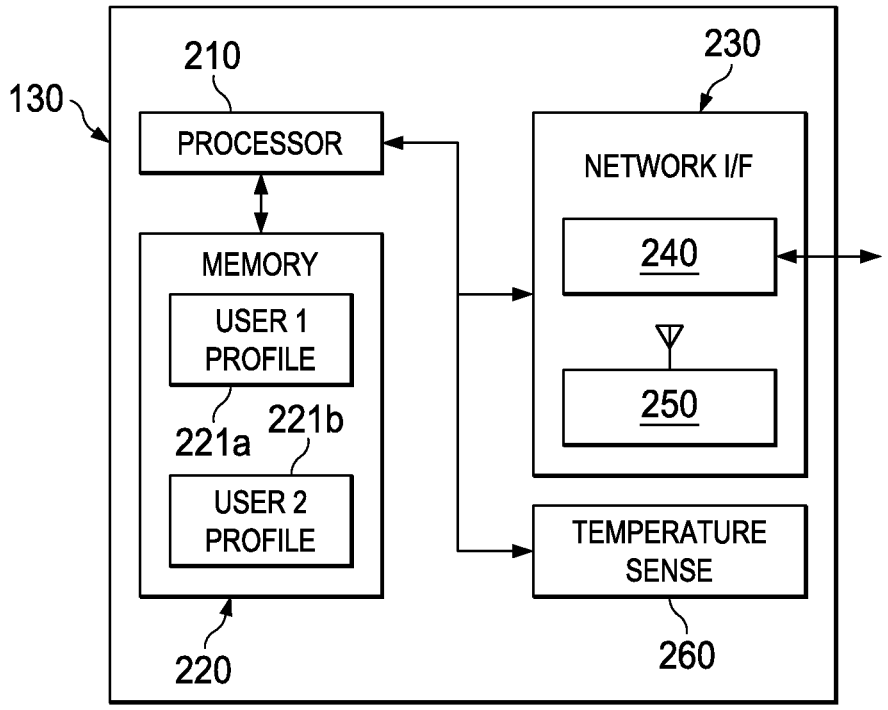

FIG. 2 illustrates the controller 130 in greater detail in one illustrative embodiment. The controller 130 includes a processor 210, a memory 220 and a network interface 230. The network interface 230 may include a wired interface 240 and a wireless interface 250. The wired interface 240 and/or the wireless interface 250 may communicate by any conventional or future-developed standard, including without limitation SMTP, TCP/IP, Bosch controller area network (CAN), IEEE-1394 (Firewire™), Universal Serial Bus (USB), Thunderbolt™, EIA-485, Bluetooth™, or IEEE 802.11 (b, g, or n).

The memory 220 includes operating instructions for the processor 210 and one or more user profiles, e.g. user profiles 221*a* and 221*b*. The user profiles 221*a* and 221*b* may include operational parameters for the HVAC system 120 that are specific to the occupant associated with that user profile. Operational parameters may include one or more user profile priorities, a group profile that describes general attributes of a group of users, preferred temperatures, time and days for which the preferred temperatures are applicable, and one or more preferred RH values. The memory 220 may also include location parameters that provide the fixed location of the controller 130

In the illustrated embodiment the controller 130 also includes an environmental sensor 260. The sensor 260 may provide data on one or more of temperature, humidity and particulate level. Within limitation the following discussion refers to temperature sensing functions of the sensor 260. The sensor 260 determines the ambient air temperature in the immediate vicinity of the controller 130. The processor 210 may control the operation of the HVAC system 120 to raise or lower the ambient air temperature, using the temperature reported by the sensor 260 as feedback. In some embodiments the controller 130 may also include an RH sensor (not shown) and control for an RH set point. In some embodiments, described further below, one or more remote sensors may replace or augment the sensor 260. Such remote sensors may provide a reading of ambient temperature at a location disjoint from the controller 130.

Figure 3A:
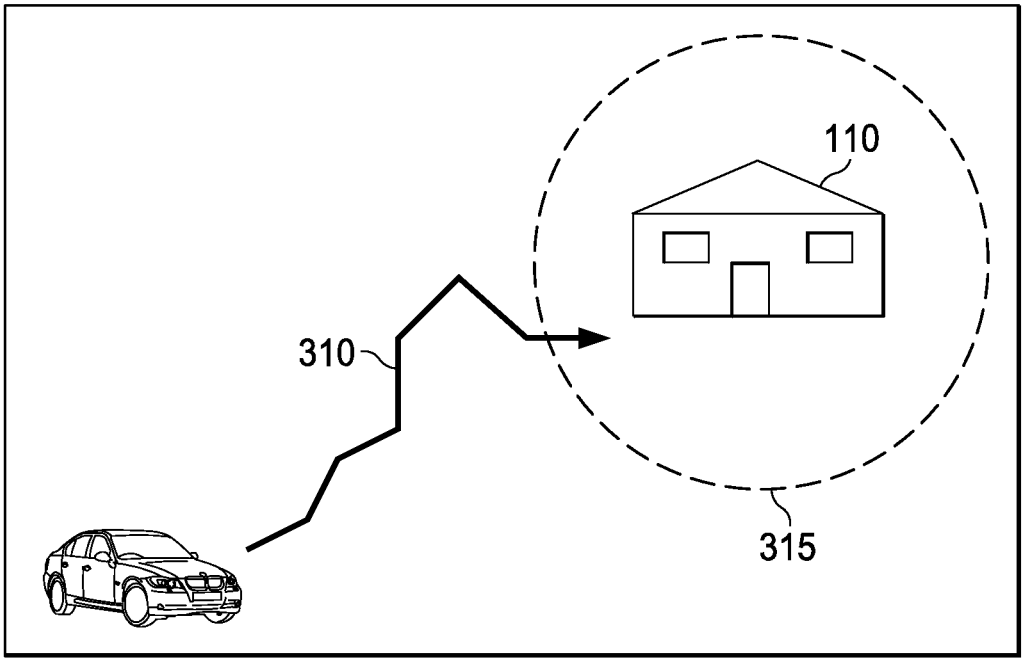
FIG. 3A illustrates a ground track for a case in which the location-reporting device converges on the HVAC system.

FIG. 3A illustrates a schematic example of a ground track 310 of the device 140 in which the ground track 310 converges on the residence 110. The controller 130 and/or the server 180 may follow the ground track 310 as it develops and at some point conclude that the ground track is likely to end at the residence 110. For example, the controller and/or the server 180 may make such a conclusion when the ground track crosses a perimeter 315 around the residence 110. The ground track analysis may include, e.g. distance between the device 140 and the residence 110, time of day, day of the week, historical data, and velocity of the device 140. The controller and/or the server 180 may in some embodiments use local road data to determine if the ground track 310 is converging, and may also track a pattern of turns associated with one or more routes that lead to the residence 110.

Figure 3B:
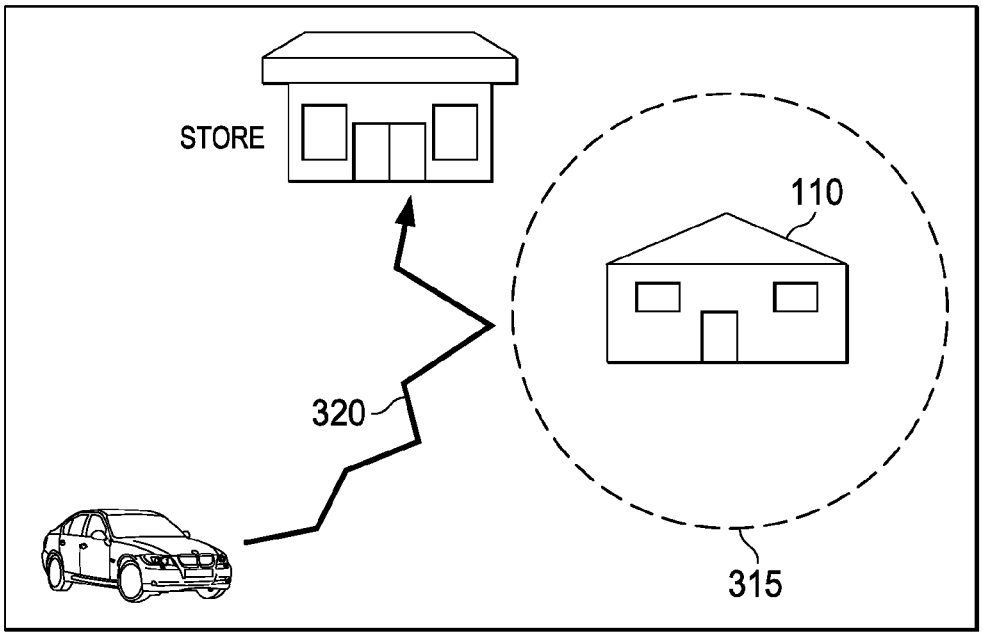
FIG. 3B illustrates a ground track for a case in which a location-reporting device diverges from an HVAC system that is configured to operate depending on the ground track.

FIG. 3B illustrates an example of a ground track 320 that fails to converge at the residence 110. The controller 130 and/or server 180 may determine at some point in the development of the ground track 320 that the device 140 is not likely to lead to the residence 110. For example, the distance between the device 140 and the residence 110 may reach a minimum and then increase. Any of the previously described data may be used in this analysis. In some cases the controller 130 and/or server 180 may reverse a previous conclusion that the ground track is converging at the residence 110 when the controller determines that a ground track that appeared to be converging is no longer doing so. For example the occupant may, as in the illustrated embodiment, initially approach the residence 110 but continue past to an unreferenced store.

When the ground track of the location-reporting device 140 is determined by the controller 130 or the server 180 to be converging on the residence 110, the controller 130 may logically change a status of the residence 110 from "unoccupied" to "occupied" before the device 140 (and its associated occupant) arrives at the residence 110. The response of the controller 130 may be configurable to perform one or more predetermined tasks when the status changes to occupied. Examples include, e.g. lower a temperature set point, raise a temperature set point, change an operating mode from heating to cooling or vice-versa, reduce or increase the relative humidity, or run a fan to circulate air without heating or cooling.

Thus, in a nonlimiting example, if the temperature set point is set back to a temperature of 17° C. when the residence 110 is unoccupied, the controller 130 may begin warming the residence 110 to 22° C. when the status changes to occupied. Optionally, the response to the ground track may be blocked during predetermined time ranges, such as normal working hours, to prevent spurious responses to a converging ground track.

As mentioned previously in some embodiments the location signal 145 includes an occupant ID. In such embodiments the controller 210 may retrieve the user profile 221 associated with the reporting device 140 and configure the system 120 accordingly. Thus, the temperature of the residence 110 may be personalized to the particular occupant in possession of the device 140 that is approaching the residence 110. The server 180 may also provide such configuring functions, e.g. by determining the configuration settings and communicating the settings to the controller 130 and/or directly to components of the HVAC system 120. Such embodiments have the advantage of reducing the computation load on the controller 130.

Figure 3C:
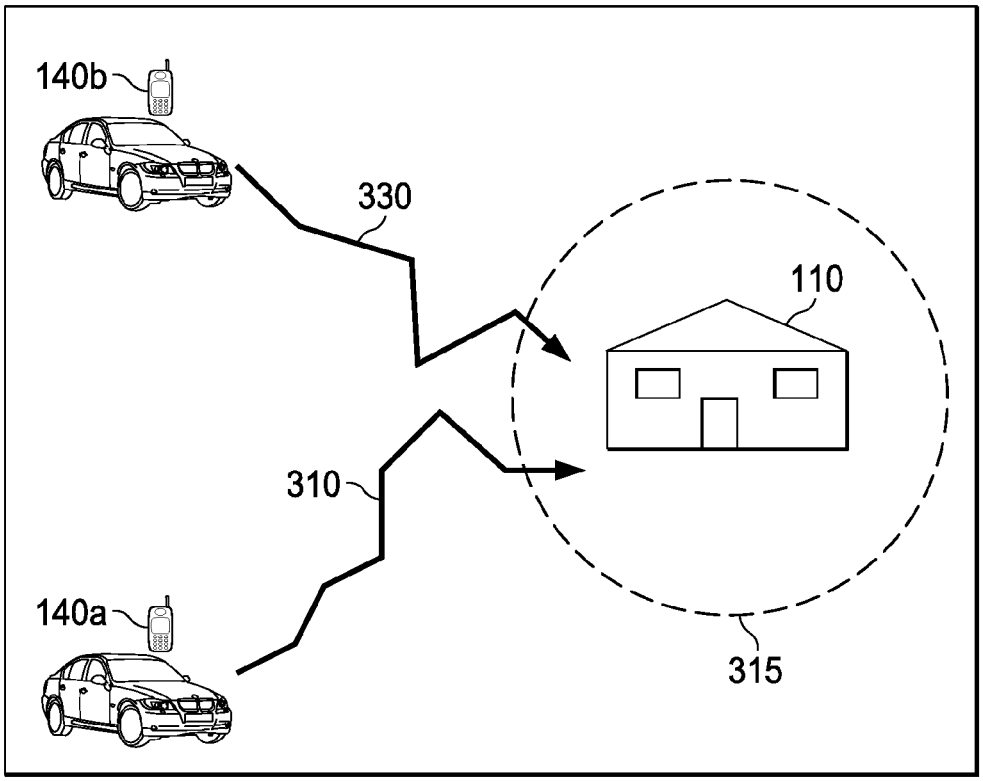
FIG. 3C illustrates ground track for a case in which two location-reporting devices converge to the HVAC system.

FIG. 3C illustrates an example in which two instances of the device 140, devices 140*a* and 140*b*, converge on the control zone 315. The device 140*a* is associated, e.g. with a first driver in the first car, converges via the ground track 310 as before. The device 140*b* is associated with a second driver in a second car, which converges via a ground track 330. The controller 130 and/or the server 180 may follow both of the devices 140*a* and 140*b*. The device 140*b*, e.g. following the ground track 330, may have priority over the device 140*a*. Such priority may be determined, e.g. by one of the user profiles 221. In one example of prioritization, the controller 130 and/or the server 180 may initially make a first control decision related to a preferred control setting of the resident carrying the device 140*a* based on the expected arrival of the device 140*a*. Subsequent to the first control decision, the controller 130 and/or the server 180 determines that device 140*b* is expected to arrive near the time of arrival of the device 140*a* and make a second control decision related to a preferred control setting of the resident carrying the second device 140*b*. In some cases the second control decision may modify or cancel an aspect of the first control decision, thus giving the carrier of the device 140*b* priority over the carrier of the device 140*a*.

Figure 4:
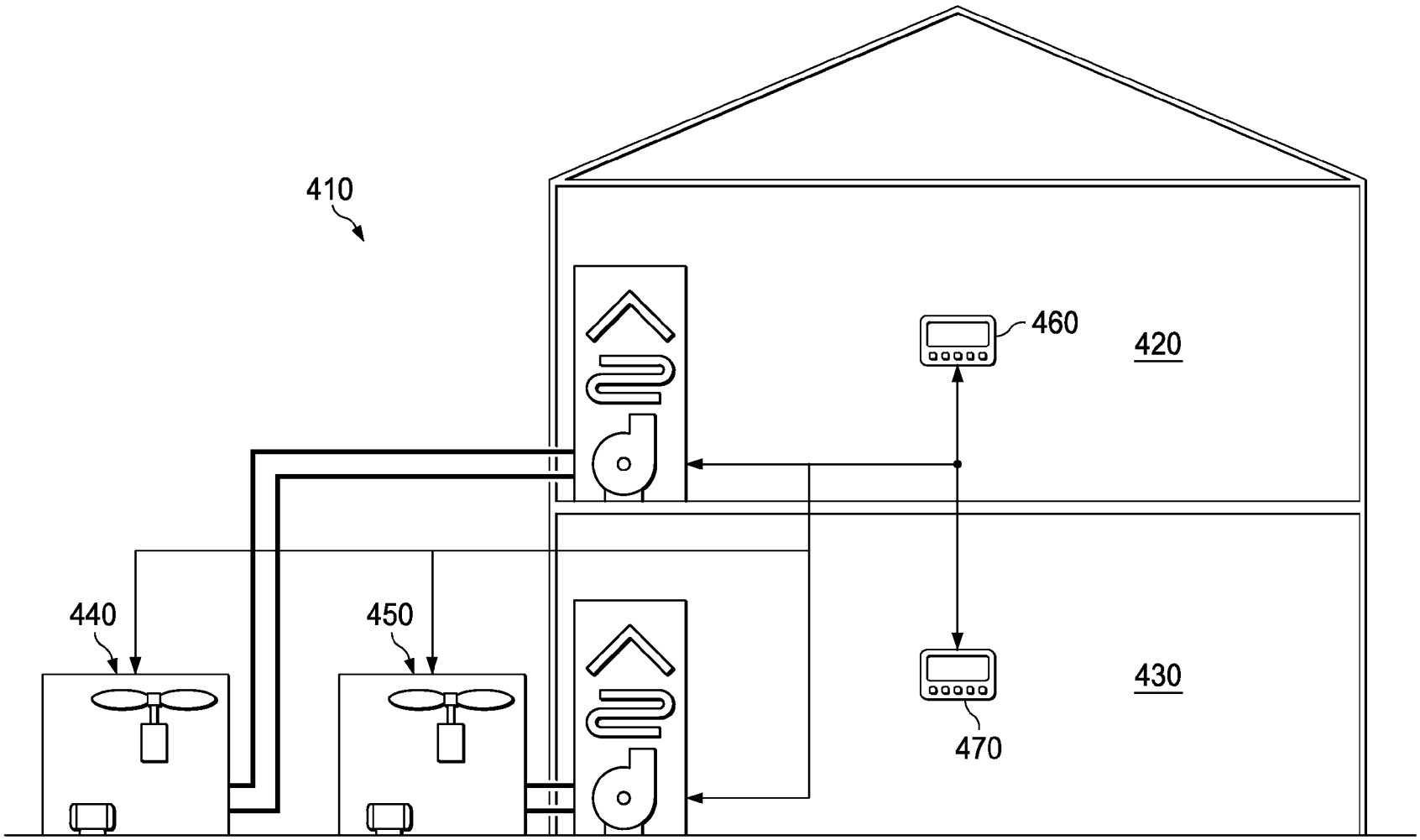
FIG. 4 illustrates a residential structure having two control zones that may be controlled in response to the location of the location-reporting device of FIG. 1.

FIG. 4 illustrates a house 410 that is configured to include two control zones 420 and 430. Herein a control zone is a portion of a structure for which one or more environmental set points may be controlled independently. In some embodiments the control zone applies to the entire structure, e.g. the structure has a single control zone. In other embodiments one control zone applies to only a portion the structure, e.g. the structure has a plurality of control zones. In such latter embodiments one or more of the environmental set points associated with one control zone may be controlled independently of one or more environmental set points associated with another control zone. In some cases each control zone is heated or cooled by an independent HVAC system as illustrated by HVAC systems 440 and 450. In other cases, not shown, the control zones may include dampers to configure airflow such that a single HVAC system can heat or cool one zone independently of other zones.

In the embodiment of FIG. 4 the zone 420 includes a controller 460, and the zone 430 includes a controller 470. The controllers 460 and 470 may be networked as illustrated, but need not be. The controllers 460 and 470 may each operate as a master controller with respect to the associated zones 420 and 430, or one controller may be slaved to the other. In some embodiments one controller, e.g. the controller 470, may be replaced by a temperature sensor (not shown) so that the controller 460 may sense the temperature in the zone 430 and control the HVAC system 450 accordingly.

The controllers 460 and 470 may respond independently to the ground track of the device 140. Thus, e.g. the controller 460 may raise a temperature set point, wile the controller 470 does nothing, or the controller 470 may raise the temperature set point by a different amount, may lower the set point, or may only run a fan to filter the air.

In FIGS. 5A-5D, aspects of an embodiment are shown in which a location-reporting device is configured to transmit a fine position of an occupant 510 to one or more instances of the controller 130. Herein and in the claims, "transmit" includes any interaction between the location-reporting device and another entity that establishes the location of the device relative to fixed references within the residence 110. In FIGS. 5A-5D two instances of the controller 130 are shown and denoted controllers 520 and 530, located in corresponding control zones 540 and 550, e.g. rooms. In some embodiments the position of the occupant 510 is determined by a location-reporting device 560 specialized for fine location reporting, e.g. not including a GPS receiver, a cellular transceiver or the like. In some embodiments the device 140 includes components that provide fine location reporting. To reflect both possibilities, the following description may concurrently refer to both the device 140 and the device 560 while recognizing that the embodiments to not require both devices to be present.

The devices 140 and 560 may include for fine positioning any of various electronic devices capable of directly reporting a location or for which the location may be determined by, e.g. interrogation by the controllers 520 and 530. For example, the device 560 may include an RFID transponder, a Bluetooth transmitter, an acoustic locator (e.g. echolocation), or may emit an RF carrier from which the location may be determined from signal strength. In some embodiments locating an occupant may includes the use of one or more of remote sensing, such as, e.g. facial recognition, thermal imaging, acoustic imaging and voice recognition. The device 560 may be worn by the occupant around the neck, carried, placed in a pocket or sewn into an article of clothing. In some embodiments the controllers 520 and 530 are configured to determine which of the controllers 520 and 530 is closest to the device 560. In some embodiments the controllers 520 and 530 are configured to determine if the device 140 or 560 is located in the same room as that controller.

In the illustrated embodiment the controller 520 may determine that the occupant 510 is located in the control zone 540. The controller 520 may in response set a temperature set point to an occupied value as determined from the user profile 221 associated with the identity of the occupant 510, e.g. 22° C. The controller 530 may determine that the occupant 510 is not located in the control zone 550, and therefore set or maintain a temperature set point at an unoccupied value, e.g. 17° C.

Figure 5A:
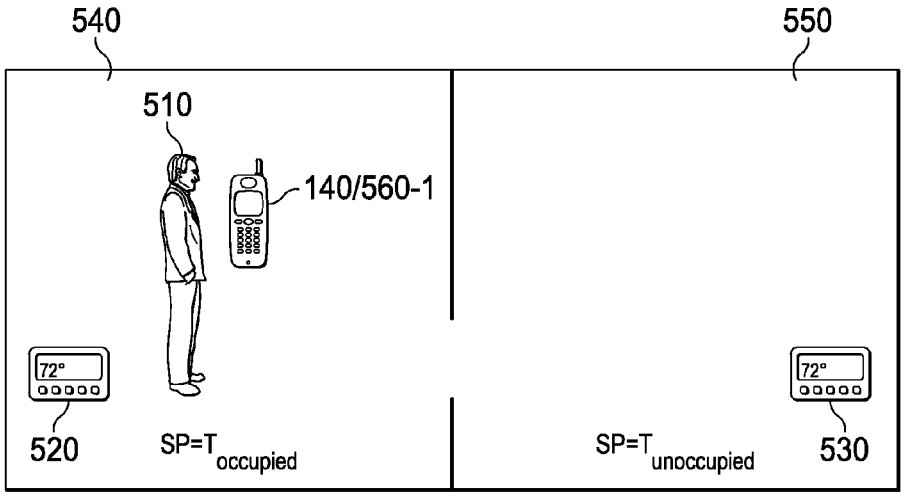
FIGS. 5A-5D illustrate aspects of controlling the control zones of FIG. 4 in which one or more occupants move between control zones.
Figure 5B:
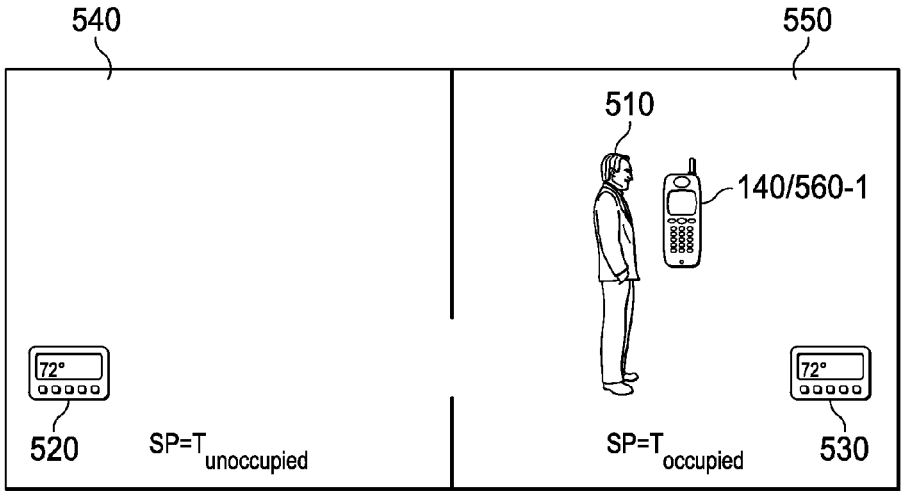

In FIG. 5B, the occupant 510 moves from the control zone 540 to the control zone 550. The controller 520 may determine that the occupant 520 is no longer in the control zone 550 and change the temperature set point to an unoccupied value. On the other hand, the controller 530 may detect the presence of the occupant 510 and set the temperature set point to the occupied value as stored in the associated user profile 221.

Figure 5C:
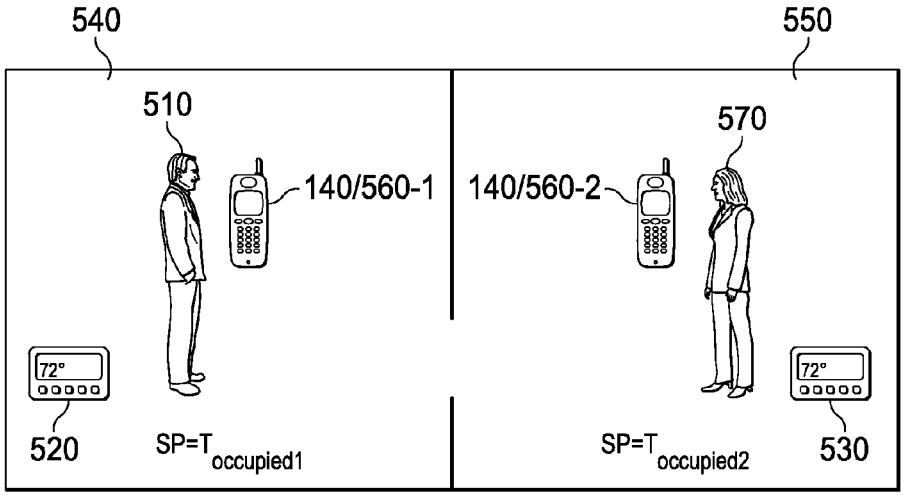

In FIG. 5C the occupant 510 is a first occupant 510, possesses a device 560-1 and occupies the control zone 540. A second occupant 570 possesses a device 560-2 and occupies the control zone 550. Each of the controllers 520 and 530 may detect the presence of the respective occupants 510, 570. The controller 520 may set the temperature set point to an occupied value stored in user 510's profile 221*a*. For example, the controller 520 may set a temperature set point at $T_{occupied1}$. The controller 530 may also set the temperature set point to an occupied value stored in user 570's profile 221*b*. For example, the controller 530 may set a temperature set point at $T_{occupied2}$.

Figure 5D:
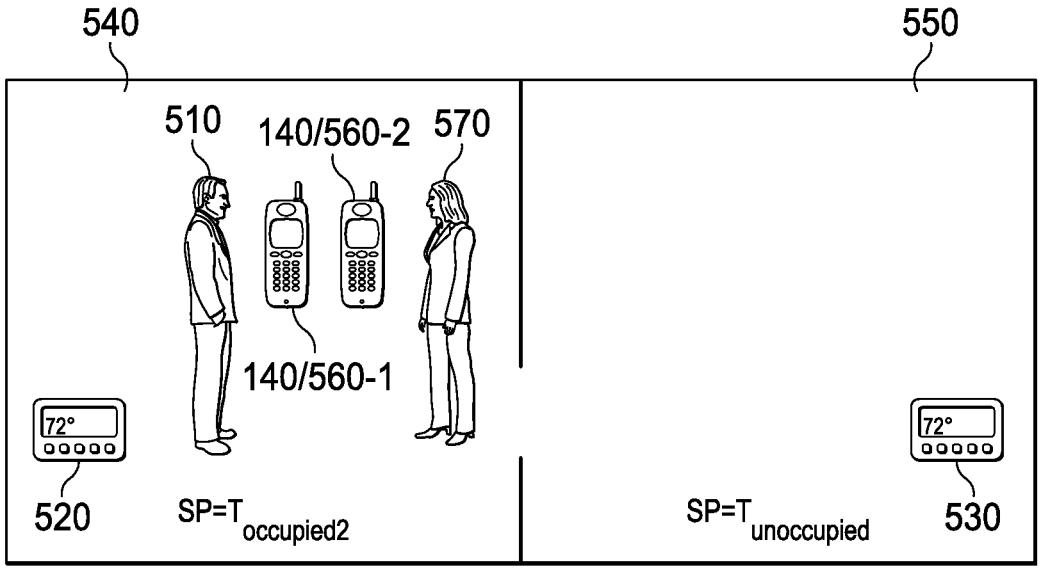

In FIG. 5D the occupant 570 moves to the control zone 540, and as before the controller 530 may set the temperature set point to an unoccupied value. In some embodiments the controller 520 is configured to maintain the temperature set point associated with the first occupant 510, e.g. $T_{occupied1}$. In other embodiments the controller 520 is configured to change the temperature set point to that associated with the newly arrived second occupant 570, e.g. $T_{occupied2}$.

In some embodiments the controller 530 is configured to disregard the location signal from a location reporting device 560-1 of the occupant 510 in the event that the controller 530 receives a second location signal from a location reporting device 560-2 of the occupant 570. In other words, the controller 530 may give priority to the user profile 221 of a particular occupant, e.g. the occupant 570. Thus, in such embodiments whenever the occupants 510 and 570 are located in a same control zone, the controller associated within that control zone controls the temperature of the control zone according to the set point associated with the higher priority occupant. If that occupant leaves the control zone, the controller may revert to a temperature set point associated with the user profile 221 of the remaining occupant.

The controllers 520 and 530, and/or the server 180, may also be configured to provide group comfort settings. This discussion refers to the operation of the controller 520 for brevity, while recognizing the controller 530 and/or the server 180 may provide the described functionality. The controller 520 may determine one or more settings of the HVAC system 110 to balance the comfort of multiple occupants. For example, the controller 520 access user profiles, e.g. the profiles 221*a* and 221*b* to obtain preferred parameter settings for each occupant. For example a first occupant may prefer a temperature of 76° F. (~24° C.), while a second occupant may prefer 72° F. (~22° C.). The controller 520 may determine an average setting $T_{occupied_group}$, e.g. 74° F. (~23° C.) to balance the preferences of the two occupants. Those skilled in the pertinent art will appreciate that this principle may be extended to other comfort parameters and any number of occupants.

Alternatively, a group profile, described earlier, may be established that includes parameters appropriate for a group of occupants. In some embodiments the group profile may simply include average comfort parameters expected to result in an overall balance of perceived comfort among the users. In some embodiments the group profile may include aspects of the described prioritization to over weight the preferences of some users over other users. In some embodiments the group profile may be configured to reflect a particular group characteristic. For example, a group profile may prioritize the preference of an occupant who is cold sensitive when the HVAC system 120 is cooling, but not prioritize that occupant's preferences when the HVAC system 120 is heating.

Figure 6:
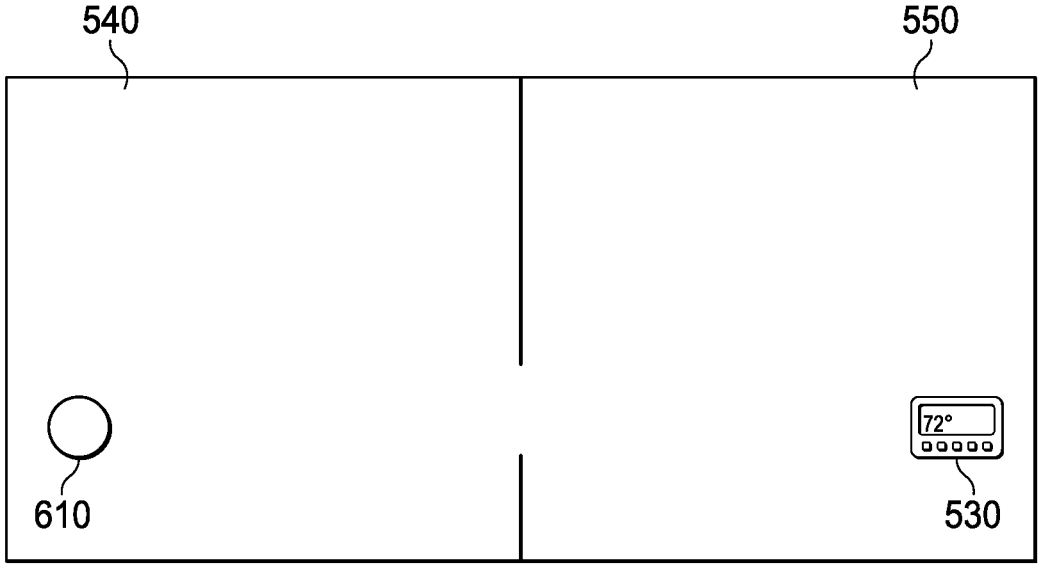
FIG. 6 illustrates an embodiment in which one control zone includes an HVAC controller, e.g. the controller of FIG. 2, and the other control zone includes a remote location sensor.

FIG. 6 illustrates an embodiment in which the controller 520 is replaced by a remote location sensor 610. The location sensor 610 may be a device specialized to interrogate the device 140 or 560 and transmit to the controller 530 data describing the position of the device 140 of 560, or transmit data from which a location may be determined. The remote location sensor 610 may communicate by wire or wirelessly, by any suitable protocol, e.g. any of the previously described communications protocols. The controller 530 may communicate with the server 180 via the router 170 to support calculations related to determining the position of the occupant.

A house such as the residence 110 may have any number of controllers and any number of remote location sensors 610. In a nonlimiting embodiment the residence 110 has a single controller such as the controller 530, and has a plurality of remote location sensors 610. In some embodiments the house includes at least one location sensor 610 in each control zone of the residence 110. However, each control zone may include as many remote location sensors 610 as needed to adequately track the location of the occupants.

Figure 7:
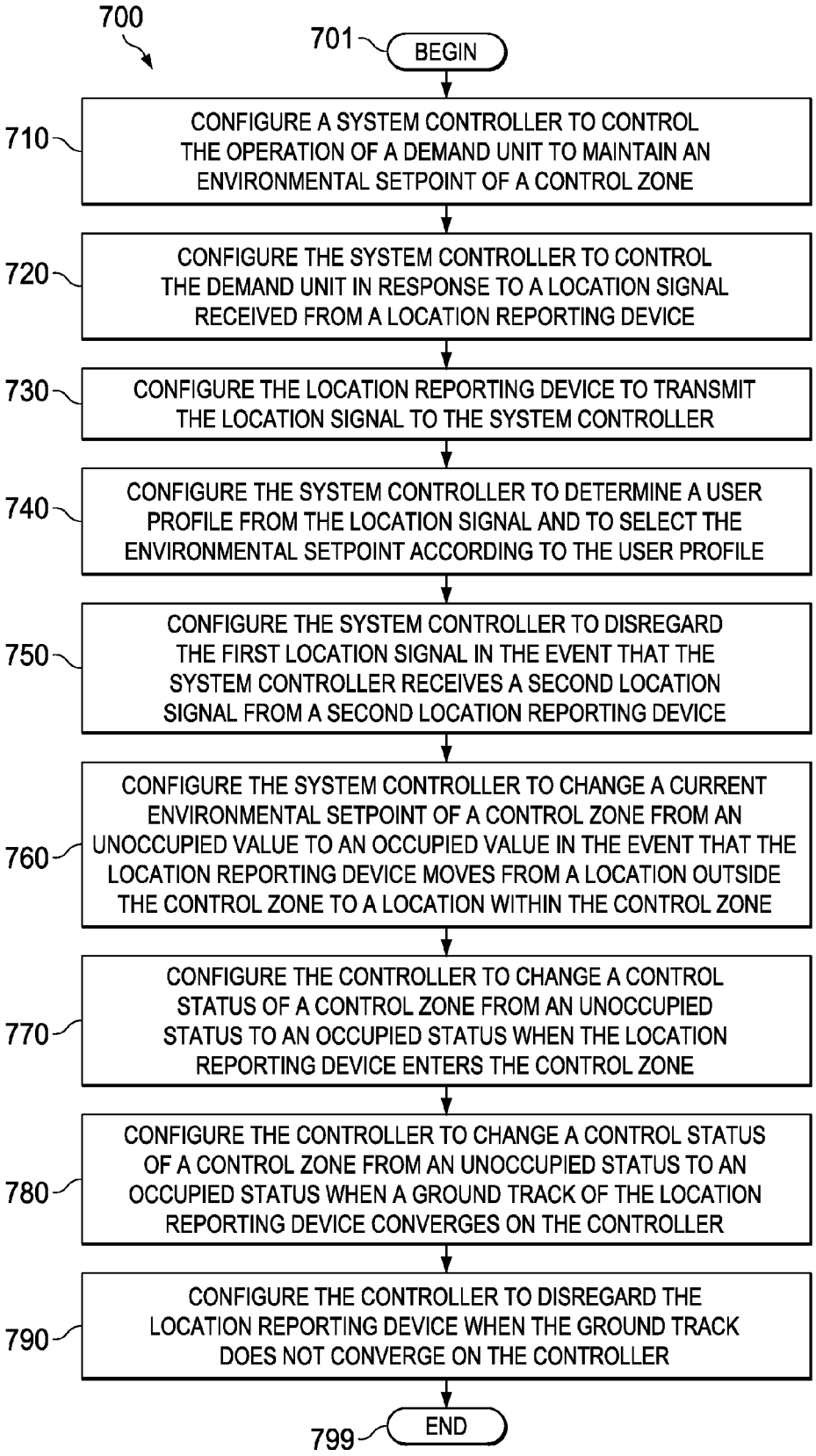
FIG. 7 illustrates a method of manufacturing an HVAC system according to various embodiments of the invention.

Turning to FIG. 7, a method 700 of manufacturing a system, e.g. an HVAC system, is presented. The method 700 is described without limitation with reference to the previously described features, e.g. in FIGS. 1-6. The steps of the method are presented in a nonlimiting order, and may be performed in another order or in some cases omitted. The method 700 begins in a step 701.

In a step 710 a system controller, e.g. the controller 130, is configured to control the operation of an HVAC system, e.g. the HVAC system 120, to maintain an environmental set point of a control zone, e.g. the zone 420. In a step 720 the system controller is configured to control the HVAC system in response to a location signal received from a location-reporting device, e.g. the device 140 or the device 560.

In a step 730 the location-reporting device is configured to transmit the location signal to the system controller.

In the preceding embodiments the location-reporting device may comprises a GPS receiver, and the location signal may include global position coordinates of the location-reporting device. In some embodiments the location-reporting device may include a Bluetooth transmitter and the system controller may be configured to determine a location of the location-reporting device from an RF carrier signal. In some embodiments the location-reporting device may include a radio frequency identification (RFID) transponder. In still other embodiments the location reporting device may include one or more remote sensors, such as, e.g. facial recognition, thermal imaging, acoustic imaging and voice recognition.

In a step 740 the system controller is configured to determine a user profile from the location signal and to select the environmental set point according to the user profile.

In a step 750 the location signal is a first location signal received from a first location-reporting device. The system controller is further configured to disregard the first location signal in the event that the system controller receives a second location signal from a second location-reporting device.

In a step 760 the system controller is configured to change a current environmental set point of a control zone, e.g. the control zone 550, from an unoccupied value to an occupied value in the event that the location-reporting device moves from a location outside the control zone to a location within the control zone.

In a step 770 the controller is configured to change a control status of a control zone from an unoccupied status to an occupied status when the location-reporting device enters the control zone.

In a step 780 the controller changes a control status of a control zone from an unoccupied status to an occupied status when a ground track of the location-reporting device converges to the location of the controller.

In a step 790 the controller is configured to disregard the location-reporting device when the ground track fails to converge on the controller. The method 700 ends in a step 799.

Those skilled in the art to which this application relates will appreciate that other and further additions, deletions, substitutions and modifications may be made to the described embodiments.

What is claimed is:

1. A heating, ventilation and air-conditioning (HVAC) system, comprising:

a system controller configured to control the operation of a demand unit to maintain an environmental set point of a control zone; and wherein said system controller is further configured to control said demand unit based, at least in part, upon a location signal received from a location-reporting device and a priority level of a user profile that corresponds to said location signal, wherein said priority level is based on an operating mode of said HVAC system.

2. The system as recited in claim 1, further comprising said location-reporting device.

3. The system as recited in claim 1, wherein said location-reporting device comprises a GPS receiver, and said location signal includes global position coordinates of said location-reporting device.

4. The system as recited in claim 1, wherein said location-reporting device is integral with clothing of a user associated with said user profile.

5. The system as recited in claim 1, wherein said location-reporting device provides location signals for both a fine position and a coarse position of said location-reporting device with respect to said control zone, wherein said fine position corresponds to a position within six meters of said control zone and said coarse position corresponds to a position greater than six meters from said control zone.

6. The system as recited in claim 5, wherein said system controller is configured to perform one or more of facial recognition, thermal imaging, acoustic imaging and voice recognition to indicate said fine position and identify a particular user.

7. The system as recited in claim 1, wherein said location-reporting device comprises a radio frequency identification (RFID) transponder.

8. The system as recited in claim 1, wherein said system controller is further configured to determine said user profile from said location signal and to select said environmental set point according to said priority level of said user profile and said operating mode of said system.

9. The system as recited in claim 1, wherein said location signal is a first location signal received from a first location-reporting device, and said system controller is further configured to disregard said first location signal in the event that said system controller receives a second location signal from a second location-reporting device.

10. The system as recited in claim 1, wherein said system controller is further configured to change a current environmental set point of a control zone from an unoccupied value to an occupied value in the event that said location-reporting device moves from a location outside said control zone to a location within said control zone.

11. The system as recited in claim 1, wherein said system controller is configured to change a control status of a control zone from an unoccupied status to an occupied status when said location-reporting device enters said control zone.

12. The system as recited in claim 1, wherein system controller is configured to change a control status of a control zone from an unoccupied status to an occupied status when a ground track of said location-reporting device converges on said controller.

13. A method of manufacturing a heating, ventilation and air-conditioning (HVAC) system, comprising:

configuring a system controller to control the operation of a demand unit to maintain an environmental set point of a control zone; and configuring said system controller to control said demand unit based, at least in part, upon a location signal received from a location-reporting device and a priority level of a user profile that corresponds to said location signal, wherein said priority level is based on an operating mode of said HVAC system.

14. The method as recited in claim 13, further comprising configuring said system controller to determine said user profile from said location signal and to select said environmental set point according to said priority level of said user profile and said operating mode of said system.

15. The method as recited in claim 13, wherein said location signal is a first location signal received from a first location-reporting device, and further comprising configuring said system controller to disregard said first location signal in the event that said system controller receives a second location signal from a second location-reporting device.

16. The method as recited in claim 13, further comprising configuring said system controller to change a current environmental set point of a control zone from an unoccupied value to an occupied value in the event that said location-reporting device moves from a location outside said control zone to a location within said control zone.

17. The method as recited in claim 13, further comprising configuring said system controller to change a control status of a control zone from an unoccupied status to an occupied status when said location-reporting device enters said control zone.

18. The method as recited in claim 13, further comprising configuring said system controller to change a control status of a control zone from an unoccupied status to an occupied status when a ground track of said location-reporting device converges to said controller.

19. A location reporting apparatus for use with a heating, ventilation and air conditioning (HVAC) system of a structure, comprising:

a locator configured to provide position data based on a location of said location reporting apparatus relative to said structure or to a system controller of said HVAC system; and a location reporter configured to transmit a location signal to said HVAC system controller that includes said position data that is employable by said system controller to operate said HVAC system, wherein said position data includes both fine position data that represents a position within six meters of said HVAC system controller and coarse position data that represents a position greater than six meters from said HVAC system controller.

20. The location reporting apparatus as recited in claim 19 wherein said locator includes a transmitter, a transceiver or a receiver selected from the group consisting of:

a GPS receiver, a cellular transceiver, a Bluetooth transmitter, and a radio frequency identification transponder.

* * * * *